US006947681B2

(12) United States Patent
Ogata

(10) Patent No.: US 6,947,681 B2
(45) Date of Patent: Sep. 20, 2005

(54) IMAGE FORMING APPARATUS WITH TWO-SPEED DEVELOPING OPERATION AND TONER CONTROL FEATURE

(75) Inventor: Takao Ogata, Chiba (JP)

(73) Assignee: Canon Kabushikik Kaisha, Tokyo (JP)

( * ) Notice: Subject to any disclaimer, the term of this patent is extended or adjusted under 35 U.S.C. 154(b) by 50 days.

(21) Appl. No.: 10/354,027

(22) Filed: Jan. 30, 2003

(65) Prior Publication Data

US 2003/0147661 A1 Aug. 7, 2003

(30) Foreign Application Priority Data

Feb. 4, 2002 (JP) ..... 2002-027427

(51) Int. Cl.[7] ..... G03G 15/10

(52) U.S. Cl. ..... 399/58; 399/60; 399/63; 399/61

(58) Field of Search ..... 399/58, 59, 60, 399/61, 62, 63, 64, 30, 74, 49

(56) References Cited

U.S. PATENT DOCUMENTS

| | | | | |
|---|---|---|---|---|
| 5,253,018 A | | 10/1993 | Takeuchi et al. | 399/49 |
| 5,310,423 A | * | 5/1994 | Aimoto et al. | 399/62 |
| 5,469,244 A | | 11/1995 | Ogata et al. | 399/30 |
| 5,559,587 A | | 9/1996 | Ogata et al. | 399/60 |
| 5,999,777 A | | 12/1999 | Masuda et al. | 399/222 |
| 6,075,954 A | | 6/2000 | Ogata et al. | 399/60 |
| 6,442,355 B2 | | 8/2002 | Hasegawa et al. | 399/58 |
| 2002/0051142 A1 | | 5/2002 | Ogata et al. | 358/1.8 |

FOREIGN PATENT DOCUMENTS

JP 05134548 A * 5/1993 ..... G03G/15/08

* cited by examiner

*Primary Examiner*—Arthur T. Grimley
*Assistant Examiner*—Ryan Gleitz
(74) *Attorney, Agent, or Firm*—Fitzpatrick, Cella, Harper & Scinto

(57) ABSTRACT

An image forming apparatus in which the control of toner supply can be effected well irrespective of an image forming mode (image forming speed). The density of a toner in a developer contained in a developer containing portion is detected by a toner density sensor. A controller controls the supply of the toner to the developer containing portion so that the density of the toner detected by the toner density sensor may assume a predetermined target value. When the last developing operation is executed at an ordinary speed, whereafter next developing operation is executed at a low speed, a toner image of predetermined density is formed, and the density of this toner image is detected by an image density sensor. The controller determines an amount of toner supply by the use of the target value corrected on the basis of the detection output of the image density sensor, and the detection output of the toner density sensor.

12 Claims, 7 Drawing Sheets

IMAGE FORMING APPARATUS WITH TWO-SPEED DEVELOPING OPERATION AND TONER CONTROL FEATURE

BACKGROUND OF THE INVENTION

1. Field of the Invention

The invention relates to an image forming apparatus using an electrophotographic process or an electrostatic recording process, and particularly to an image forming apparatus such as a copying machine, a printer or a FAX.

2. Description of the Related Art

In some of conventional image forming apparatuses such as copying machines, printers and facsimile apparatuses, for example, a toner image is formed on an image bearing member by the use of an electrophotographic process, and the toner image is transferred to a recording material.

FIG. 6 of the accompanying drawings schematically shows the construction of an image forming apparatus using such a conventional electrophotographic process, and in FIG. 6, the reference numeral 1 designates a photosensitive drum, the reference numeral 2 denotes a contact charger for charging the surface of the photosensitive drum 1, the reference numeral 3 designates a laser beam scanner using, for example, a semiconductor laser which is an exposing device as information writing means for forming an electrostatic latent image on the surface of the photosensitive drum 1, and the reference numeral 4 denotes a developing device.

When an image is to be formed in such a conventional image forming apparatus, the surface of the photosensitive drum 1 is first charged by the contact charger 2, whereafter a laser beam modulated according to an image signal sent from a host apparatus such as an image reading apparatus (not shown) to the image forming apparatus side is outputted by the laser beam scanner 3, and the uniformly charged surface of the photosensitive drum 1 is subjected to laser scanning exposure L (image exposure) at an exposing position b.

When such laser scanning exposure L is effected, the potential of that portion of the surface of the photosensitive drum 1 to which the laser beam has been applied drops, whereby an electrostatic latent image corresponding to the scanning-exposed image information is sequentially formed on the surface of the photosensitive drum 1.

Next, the electrostatic latent image is developed by the developing device 4, whereby a toner image is obtained on the photosensitive drum 1. Thereafter, the toner image is electrostatically transferred to the surface of a recording material (transfer material) P fed from a feed mechanism portion (not shown) at predetermined control timing at a transferring portion "d" constituted by a transfer roller 5*d*' which is a transfer charger urged against the photosensitive drum 1 with a predetermined pressure force and the photosensitive drum 1.

That is, the recording material P fed to the transferring portion d is transported by being nipped between the rotating photosensitive drum 1 and transfer roller 5*d*' and in the meantime, a transfer bias of the positive polarity which is opposite to the negative polarity which is the regular charging polarity of the toner is applied from a power source S3 to the transfer roller 5*d*', whereby the toner image on the surface of the photosensitive drum 1 is sequentially electrostatically transferred to the upper surface of the recording material P.

Next, when it thus passes the transferring portion "d", the recording material P to which the toner image has been transferred is sequentially stripped off from the surface of the photosensitive drum 1 and is transported to a fixing device, e.g. a thermal roller fixing device 6, where it is subjected to the fixing process of the toner image, and thereafter is outputted as an image-formed article (a print or a copy).

Now, the developing device 4 for visualizing the electrostatic latent image on the photosensitive drum 1, as shown in FIG. 6, is provided with a rotatable nonmagnetic developing sleeve 4*b*, a stationary magnet roller 4*c* inserted in the developing sleeve 4*b*, a developer coating blade 4*d*, a developer agitating member (screw) 4*f* for agitating and circulating a two-component developer having toner and carrier contained in a developing container 4*a* to thereby rub the toner and the carrier against each other and triboelectrify the developer, and a toner hopper 4*g* containing a supply toner (not shown) therein.

The developing sleeve 4*b* is disposed in proximity to and in opposed relationship with the photosensitive drum 1 with its closest distance to the photosensitive drum 1 kept constant. Also, this developing sleeve 4*b* is adapted to be rotatively driven in a direction opposite to the direction of rotation of the photosensitive drum 1 in a developing portion "c", which is a portion opposed to the photosensitive drum 1.

Further, the two-component developer in the developing container 4*a* is attracted to and held on the outer peripheral surface of the developing sleeve 4*b* as a magnetic brush layer by the magnetic force of the stationary magnet roller 4*c* in the developing sleeve.

The two-component developer thus attracted to and held on the developing sleeve 4*b* is transported with the rotation of the developing sleeve 4*b*, and is adjusted into a predetermined thin layer by the developer coating blade 4*d*, whereafter in the developing portion "c", it contacts with the photosensitive drum 1 and moderately rubs against the surface of the photosensitive drum.

Also, at this time, a predetermined developing bias, e.g. a vibration voltage comprising a DC voltage (Vdc) and an AC voltage (Vac) superimposed one upon the other, is applied from a power source S4 to the developing sleeve 4*b*. Thereby, the electrostatic latent image on the surface of the photosensitive drum 1 is visualized by the toner.

On the other hand, FIG. 7 of the accompanying drawings shows another construction of the conventional developing device 4, and as shown in FIG. 7, a regulation member 4*d* is in proximity to the developing sleeve 4*b*, and when the two-component developer passes this proximate portion, the charging of the toner "t" is adapted to be effected by the triboelectrification between the developing sleeve 4*b* and the regulation member 4*d*.

Now, there has also been produced an image forming apparatus in which the process speed (corresponding to the rotating speed of the photosensitive drum, the developing sleeve 4*b* or the screw 4*f*) is changed in conformity with the kind of the recording material to thereby form an image. That is, when the recording material is plain paper, an ordinary speed mode in which the process speed is selected to an ordinary speed is adopted, and when the recording material is thick paper, a low speed mode in which the process speed is selected to a low speed is adopted, and when the recording material is an OHP sheet (light transmissive resin), a lowest speed mode in which the process speed is selected to the lowest speed is adopted.

When in such an apparatus, there is adopted a construction in which by the use of a magnet sensor 14 for detecting a change in the permeability of the developer in the developing device to thereby detect the density of the toner in the developer, the control of the supply of the toner to the developing device 4 is effected, the following inconvenience has occurred.

With the change of the image forming mode, i.e., the image forming speed, the transport speed (circulation speed) of the developer by the screws 4*f*, 4*e* is changed and at the same time, the flow speed of the developer flowing through an area opposed to the detecting surface of the magnetic sensor 14 is also changed, and in conformity with this change in the flow speed of the developer, the output from the magnetic sensor 14 changes greatly.

That is, when the image forming speed is changed, the output of the magnetic sensor 14 immediately before and immediately after the change of the image forming speed changes greatly in spite of the toner in the developing device 4 being not consumed and therefore, the control of the toner supply thereafter such as for the oversupply of the toner or the deficient supply of the toner could not be executed well.

SUMMARY OF THE INVENTION

It is an object of the present invention to provide an image forming apparatus in which irrespective of the operated situation of the apparatus, a proper amount of the toner can be supplied to a developing device.

Further objects of the present invention will become apparent from the following detailed description when read with reference to the accompanying drawings.

DESCRIPTION OF THE PREFERRED EMBODIMENTS

Some embodiments of the present invention will hereinafter be described in detail with reference to the drawings.

Figure 1:
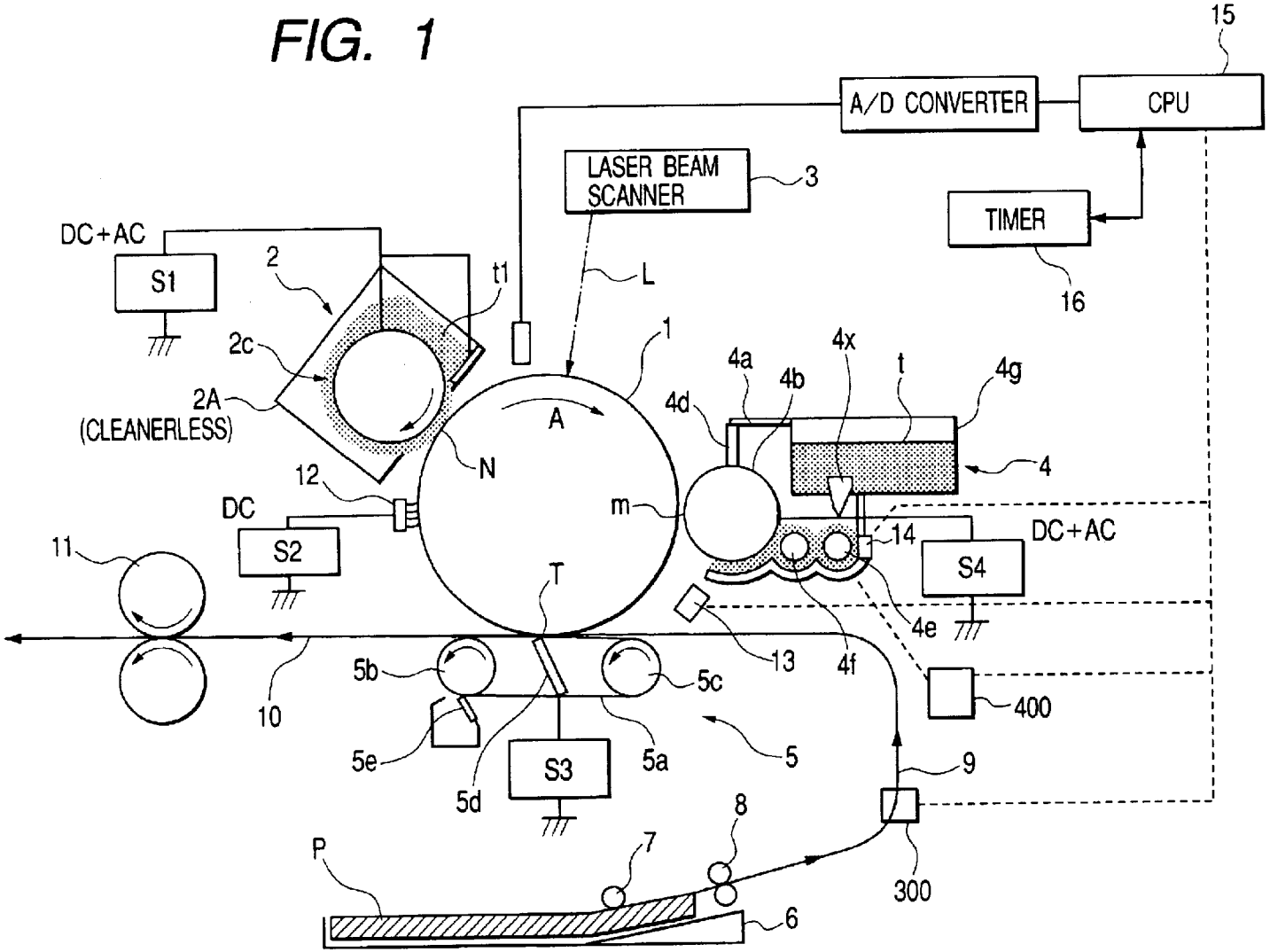
FIG. 1 schematically shows the construction of a laser beam printer which is an example of an image forming apparatus according to a first embodiment of the present invention.

FIG. 1 schematically shows the construction of a laser beam printer which is an example of an image forming apparatus according to a first embodiment of the present invention. The laser beam printer uses the transfer type electrophotographic process and the charge injection charging method.

In FIG. 1, the reference numeral 1 designates a rotary drum type electrophotographic photosensitive member (hereinafter referred to as the photosensitive drum) as an image bearing member. The photosensitive drum 1 is a negatively chargeable and charge injection chargeable OPC photosensitive member (organic photoconductor), and is rotatively driven in the clockwise direction indicated by the arrow A.

The reference numeral 2 denotes a magnetic brush charging device which is a contact charging device for uniformly charging the surface of the photosensitive drum 1 to a predetermined polarity and potential, and by the magnetic brush charging device 2, the surface of the photosensitive drum 1 being rotated is uniformly charged to about −700 V by the charge injection charging method.

The reference numeral 3 designates a laser beam scanner which is image information exposing means (exposing device), and the laser beam scanner 3 is adapted to emit a laser beam L modulated according to the time-series electrical digital pixel signal of desired image information inputted from a host apparatus such as an original reading apparatus having a photoelectric conversion element such as a CCD (not shown), an electronic computer or a word processor, and scan and expose the uniformly charged surface of the photosensitive drum 1 to the laser beam. By the laser beam scanning exposure being thus effected, an electrostatic latent image corresponding to the desired image information is formed on the peripheral surface of the photosensitive drum 1.

The reference numeral 4 denotes a developing device for developing the electrostatic latent image formed on the peripheral surface of the photosensitive drum 1, and the developing device 4 is provided with a developing container 4*a* which is a developer containing portion containing a developer therein, a developing sleeve 4*b* which is a developer bearing member rotatably provided at a location in the developing container 4*a* which is opposed to the photosensitive drum 1 for transporting the developer to the photosensitive drum 1, a developer coating blade 4*d*, developer agitating members (screw members) 4*e*, 4*f* for agitating and transporting the developer, and a toner hopper 4*g* containing a supply toner "t" therein. Design is made such that the supply toner "t" is supplied into the developing device in conformity with the output of a toner density detecting sensor, which will be described later.

The developing sleeve 4*b* and the developer agitating member (screw member) 4*f* are designated such that drive is inputted thereto from the same driving system, and as will be described later, when an image forming mode, i.e., an image forming speed (process speed), is changed in conformity with the kind of a recording material, both of the developing sleeve 4*b* and the developer agitating member (screw member) 4*f* are changeable to the lowest speed/a low speed/an ordinary speed while maintaining a state in that the developing sleeve 4*b* is the same speed as the developer agitating member 4*f*.

In the present embodiment, as the developing device 4, use is made of a two-component contact type developing device using a two-component developer comprising a mixture of a high mold releasing ability spherical nonmagnetic toner suffering little from non-transfer which has been produced by a polymerizing method and a magnetic carrier, and discharged-area-developing the electrostatic latent image on the surface of the photosensitive drum 1 as a toner image.

The reference numeral 5 designates a transferring device disposed below the photosensitive drum 1, and the transferring device 5 is provided with an endless transfer belt 5*a* as a recording material bearing member of a film thickness 75 μm formed, for example, of polyimide. The transfer belt 5*a* is stretched around a driving roller 5*b* and a driven roller 5*c* and is rotated in a forward direction relative to the direction of rotation of the photosensitive drum 1 at substantially the same peripheral speed as the rotational peripheral speed of the photosensitive drum 1.

Also, the transferring device 5 is provided with an electrically conductive blade 5*d* as a transfer charger (transfer bias applying portion) disposed inside the transfer belt 5*a*, and by the electrically conductive blade 5*d*, the upper belt portion of the transfer belt 5*a* is pressed against the undeside portion of the photosensitive drum 1 to thereby form a transfer nip portion T as a transfer region. The reference character 5*e* denotes a cleaning blade abutting against the outer surface of the transfer belt 5*a*.

The reference numeral 6 designates a feed cassette containing therein a stack of recording materials P such as paper, and the reference numeral 7 denotes a feed roller for feeding the recording materials P stacked and contained in the feed cassette 6.

Description will now be made of the image forming operation of the laser beam printer constructed as described above.

First, when the image forming operation is started, one of the recording materials P stacked and contained in the feed cassette 6 is separated and fed by the driving of the feed roller 7, and passes along a sheet path 9 including transport rollers 8, etc. and is fed to the transfer nip portion T between the photosensitive drum 1 and the transfer belt 5*a* of the transferring device 5 at predetermined control timing.

The recording material P thus fed to the transfer nip portion T is nipped and transported between the photosensitive drum 1 and the transfer belt 5*a*. In the meantime, a predetermined transfer bias is applied from a transfer bias applying power source S3 to the electrically conductive blade 5*d*, whereby charging opposite in polarity to the toner is done to the recording material P from the back thereof. As a result, the toner image on the photosensitive drum 1 is sequentially electrostatically transferred to the surface of the recording material P passing through the transfer nip portion T.

Next, the recording material P which has passed through the transfer nip portion T and has received the transfer of the toner image is sequentially separated from the surface of the photosensitive drum 1 and passes along a sheet path 10 and is introduced into a thermal roller fixing device 11 which is fixing means, whereafter it is subjected to the fixing process of the toner image thereon and is printed out. Any toner adhering to the surface of the transfer belt 5*a* is removed by a cleaning blade 5*e*.

Now, the laser beam printer according to the present embodiment adopts a cleanerless process, and is designed such that any toner not transferred to the recording material P at the transfer nip portion T but remaining on the surface of the photosensitive drum 1, as will be described later, comes to the position of the magnetic brush charging device 2 owing to the continued rotation of the photosensitive drum 1, and is temporarily collected by the magnetic brush portion of a magnetic brush charger 2A which is in contact with the photosensitive drum 1. The thus temporarily collected toner t1 is thereafter again discharged to the surface of the photosensitive drum 1 and is finally collected into the developing device 4, and the photosensitive drum 1 is respectively used for image formation.

The reference numeral 12 designates an electrically conductive brush as an auxiliary contact charging member abutting against the surface of the photosensitive drum 1 between the transferring device 5 and the magnetic brush charging device 2. The electrically conductive brush 12 has applied thereto from a power source S2, an AC bias or a DC bias opposite in polarity to charging or a DC bias opposite in polarity to charging and having an AC bias superimposed thereon, and serves to uniformize the surface potential of the photosensitive drum immediately before the charging by the magnetic brush charging device 2 and at the same time, eliminate the charges of any untransferred toner or charge it to a polarity opposite to the charging of the photosensitive drum 1 to thereby facilitate the collection of the toner by the magnetic brush portion of the magnetic brush charger 2A.

Figure 2:
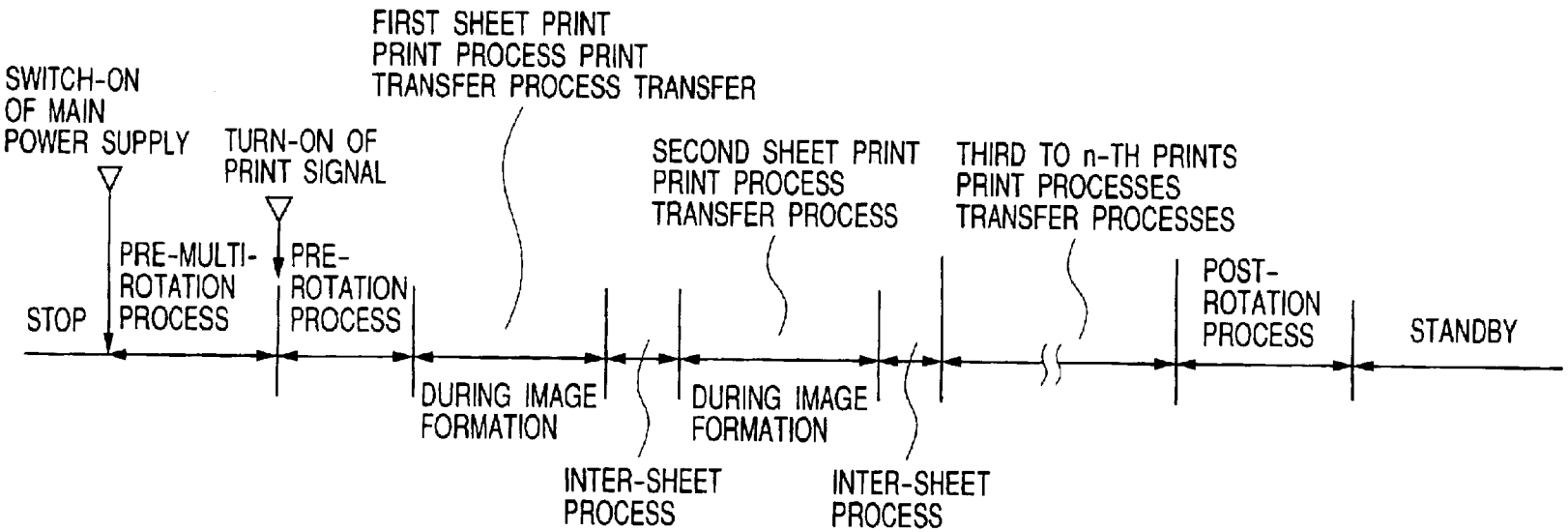
FIG. 2 illustrates the operation sequence of the laser beam printer.

On the other hand, FIG. 2 shows the operation sequence of such a laser beam printer, and the laser beam printer has the following processes (periods):

(1) Pre-multi-rotation Process

This process has a period for effecting the starting operation of the laser beam printer (a starting operation period or a warming period), and is the process of driving the main motor of the apparatus by the switch-on of a main power supply to thereby rotatively drive the photosensitive drum 1, and execute the preparatory operation of a predetermined process apparatus.

(2) Pre-rotation Process

This process has a period for executing a pre-printing operation, and is a process executed continuedly from the pre-multi-rotation process when a printing signal is inputted during the pre-multi-rotation process. When in this process, the printing signal is not inputted, the driving of the main motor is once stopped after the termination of the pre-multi-rotation process and the rotative driving of the photosensitive drum 1 is stopped, and the printer is kept on standby until the printing signal is inputted.

(3) Printing Process (Image Forming Process or Image Making Process)

This process is executed when the predetermined pre-rotation process is terminated, and is a process for making an image on the photosensitive drum 1 continuedly from the predetermined pre-rotation process, and a process in which the transfer of the toner image formed on the surface of the photosensitive drum to the recording material, and the fixing of the toner image by the fixing means are done and an image-formed article is printed out. In the case of a continuous printing mode, this process is repetitively executed corresponding to a predetermined set number of prints "n".

(4) Inter-sheet Process

This process is a process for obtaining a non-sheet passing state period for the recording material at the transfer nip portion from after in the continuous printing mode, the trailing edge of a recording material to which the toner image has been transferred has passed the transfer nip portion until the leading edge of the next recording material arrives at the transfer nip portion.

(5) Post-rotation Process

This process is a process for obtaining a period during which after the printing process for the nth sheet which is the last sheet has been terminated, the driving of the main motor is still continued for a while to thereby rotatively drive the photosensitive drum 1 and execute a predetermined post-operation.

(6) Standby

This process is a process for keeping the printer on standby from after the predetermined post-rotation process has been terminated until the driving of the main motor is stopped to thereby stop the rotative driving of the photosensitive drum and the next print starting signal is inputted. In the case of the printing of only one sheet, after the termination of that printing, the printer assumes its standby via the post-rotation process. Also, when a print starting signal is inputted in the standby, the printer shifts to the pre-rotation process.

Here, the time during the printing process mentioned under item (3) above is the image formation period, and the pre-multi-rotation process mentioned under item (1) above, the pre-rotation process mentioned under item (2) above, the inter-sheet process mentioned under item (4) above and the post-rotation process mentioned under item (5) above are the non-image formation period (non-image making period).

Now, as already described, the untransferred toner not transferred to the recording material P at the transfer nip portion T but remaining on the surface of the photosensitive drum 1 is temporarily collected by the magnetic brush portion of the magnetic brush charger 2A of the magnetic brush charging device 2, but at this time, the untransferred toner on the photosensitive drum 1 after consists of a mixture of particles of positive polarity and particles of negative polarity due to the separation electric-discharge or the like during the transfer.

However, even when the polarities of the untransferred toner are thus mixed with each other, the untransferred toner is charged to the regular charging polarity (in the present embodiment, the negative polarity) while it passes the electrically conductive brush 12, whereby the untransferred toner comes to the magnetic brush charger 2A in a state in which the charging polarity thereof has been uniformized, and mixes in the magnetic brush portion 2*c* and is temporarily collected thereby.

The introduction of the untransferred toner into the magnetic brush portion 2*c* of the magnetic brush charger 2A can be more effectively done by applying a DC+AC component to the magnetic brush charger 2A to thereby induce a vibration electric field effect between the magnetic brush charger 2A and the photosensitive drum 1.

All of the untransferred toner introduced into the magnetic brush portion 2*c* is then charged to the negative polarity and is discharged onto the photosensitive drum 1. The untransferred toner having had its polarity uniformized to the negative polarity and discharged onto the photosensitive drum 1 comes to a developing portion "m" and is collected by cleaning simultaneous with developing with the aid of a fog removal electric field during developing on the developing sleeve 4*d* of the developing device 4. The collection of the untransferred toner simultaneous with developing progresses simultaneously with the other image forming steps such as charging, exposing, developing and transferring when the image area in the direction of rotation is longer than the circumferential length of the photosensitive drum 1.

Now, in FIG. 1, the reference numeral 13 designates an image density detecting sensor which is image density detecting means for detecting the density of a patch image for image density detection which is a toner image of predetermined density formed on the photosensitive drum 1, and the reference numeral 14 denotes a magnetic sensor which is toner density detecting means provided on a side wall portion of the developing container which is opposed to the screw 4*e* for magnetically detecting the density of the toner in the developer in the developer containing portion 4*a*. The magnetic sensor is designed to detect any change in the permeability of the developer, in other words, detect any increase or decrease in the amount of the magnetic carrier contained in a predetermined volume in an opposed area to thereby detect the density of the toner. Also, the reference numeral 15 designates a control device CPU for controlling and determining the amount of toner to be supplied from the hopper 4*g* to the developing container 4*a* by comparing the toner density (output) detected by the magnetic sensor 14 with a predetermined target value.

In the present embodiment, the CPU 15 is adapted to determine a target value v0 when a new developing device 4 is installed in the laser beam printer, and also to effect toner supply so that the detection output of the magnetic sensor 14 may assume the target value, thereby controlling the T/D ratio (toner weight/toner carrier weight ratio) in the developing device. That is, it is adapted to effect feedback to the control target value v0 of the developer density, and effect toner supply so that the developer density (the output value of the magnetic sensor) may become equal to the target value.

Now, in the present image forming apparatus, design is made such that the image forming speed, i.e., the process speed (corresponding to the rotating speeds of the photosensitive drum, the developing sleeve 4*b*, the screw 4*f*, the transfer belt 5*a* and the fixing device 11) is changed in conformity with the kind of the recording material to thereby effect image formation.

Specifically, the control device CPU 15 is designed to select an ordinary speed mode in which the process speed is selected to an ordinary speed when the recording material is plain paper, select a low speed mode in which the process speed is selected to a low speed when the recording material is thick paper, and select a lowest speed mode in which the process speed is selected to the lowest speed when the recording material is an OHP sheet (light transmissive resin) to thereby execute image formation.

As a method of detecting the kind of the recording material, a method of providing a media sensor 300 in the image forming apparatus and automatically detecting it is adopted. The method of detecting the kind of the recording material may adopt a construction in which a user inputs the kind of the recording material from a liquid crystal display portion provided on the upper portion of the image forming apparatus, and transmits the information to the CPU 15 to thereby effect control.

On the other hand, as already described, the present image forming apparatus is of a construction in which the control of the toner supply to the developing device 4 is effected by the use of the magnetic sensor 14 for detecting any change of the permeability of the developer in the developing device to thereby detect the density of the toner in the developer and therefore, with a change in the image forming speed, the developer transport speed by the screws 4*f*, 4*e* (the speed at which the developer is circulated in the developing container) is changed and the flow speed of the developer flowing in an area opposed to the detecting surface of the magnetic sensor 14 is also changed, and in conformity with the change in the flow speed of the developer, the output from the magnetic sensor 14 changes greatly. Also, it is sometimes the case that at this time, the height of the level of the developer is changed and because of this, the output from the magnetic sensor 14 changes greatly.

That is, by the image forming mode being only changed (the image forming speed being only changed), the output of the magnetic sensor 14 immediately before and immediately after the changing of the image forming mode (image forming speed) is greatly changed in spite of the toner in the developing device 4 having not been consumed, whereby the control of the toner supply thereafter such as the over-supply of the toner or the deficient supply of the toner could not be executed well.

Figure 3:
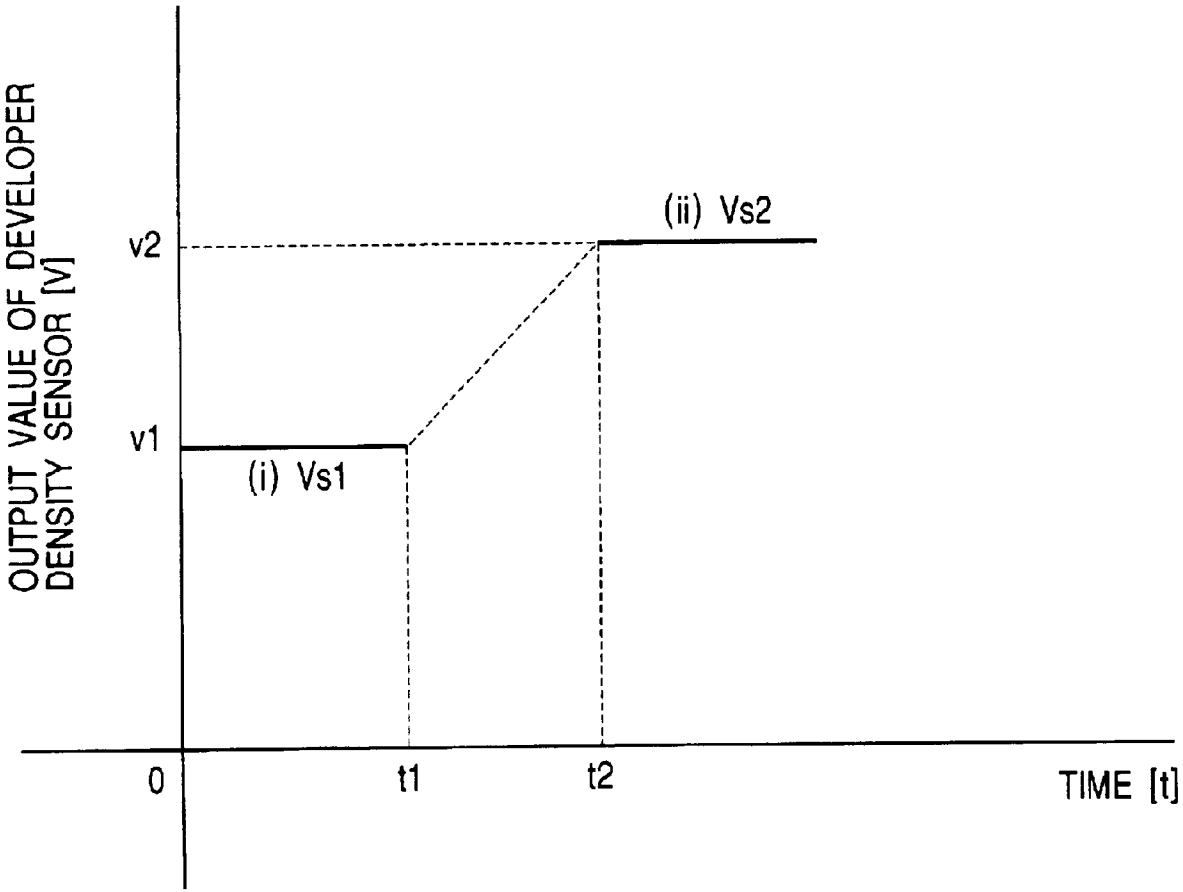
FIG. 3 is a graph showing the relation between the output of a magnetic sensor and the time for which the laser beam printer is left as it is.

When for example, the copying operation is being performed in the ordinary speed mode (speed Vs1), the value of the magnetic sensor 14 is stable about v1 as indicated by (i) (time 0-t1) in FIG. 3, but when the above-described pre-rotation operation or the image forming operation is started in a state in which the low speed mode is selected on the basis of the kind of the recording material having been changed at a time t2 and the image forming speed has been changed to a low speed Vs2, the output of the magnetic sensor 14 increases as indicated by (ii) in FIG. 3.

That is, in spite of the density of the toner in the developer in the same developing device being substantially not changed, by the image forming mode, i.e., the image forming speed being only changed, the output value of the magnetic sensor 14 is changed from v1 to v2. As the result, the CPU 15 misjudges the toner density. In FIG. 3, the axis of abscissas represents time "t", and the axis of ordinates represents the output value "v" of the magnetic sensor 14.

So, when the CPU 15 recognizes the changing of the image forming speed, a patch latent image as a predetermined toner image is formed on the photosensitive drum 1 by the charging device 2 and the exposing device 3 during the pre-rotation before the image formation after the changing of the image forming speed is started, and this is developed by the developing device 4 to thereby form a patch image. Thereafter, the CPU 15 detects the density of the patch image by the image density detecting sensor 13 and converts the detected density of the patch image and effects feedback so as to correct and determine a coefficient A for correcting the output value of the magnetic sensor 14 during toner supply. Specifically, the coefficient A added to the output value v2 of the magnetic sensor 14 is corrected (v2'=v2+A).

As described above, the correction of the output value v2 of the magnetic sensor 14 during toner supply is effected by this feedback control. As the result, the CPU 15 compares the output value v2' after the above-described correction with the target value V0 to thereby determine an amount of toner supply, and drives a supplying device 4*x* for a time corresponding to this amount of toner supply to thereby effect the control of toner supply.

Thereby, it is possible to prevent bad toner supply attributable to the change of the output of the magnetic sensor caused by a change in the developing operation speed of the developing device, and the stabilization of the control of toner supply can be achieved. As described above, the output v2 itself of the magnetic sensor 14 during toner supply is corrected, whereby as compared with a construction in which for each image forming mode, a target value is set as a table, the amount of data to be stored in a memory can be made small and further, the construction for the control of toner supply can be simplified.

Instead of the output v2 of the magnetic sensor 14 during toner supply (specifically the coefficient A) being corrected on the basis of the result of the detection of the density of the patch image as described above, the target value v0 with which the output value v2 of the magnetic sensor 14 during toner supply is to be compared may be corrected on the basis of the result of the detection of the density of the patch image.

That is, the CPU 15 may be designated to compare the output value v2 of the magnetic sensor 14 during toner supply with the target value v0' corrected on the basis of the result of the detection of the density of the patch image to thereby determine the amount of toner supply, and drive the supplying device 4*x* for a time corresponding to this amount of toner supply to thereby effect the control of toner supply.

Also, instead of the density of the patch image as the predetermined toner image being detected on the photosensitive drum and the feedback control thereafter being effected as described above, there may be adopted, for example, a construction in which the image density detecting sensor 13 is disposed at a location opposed to the transfer belt and the patch image formed on the photosensitive drum is directly transferred to the transfer belt as a transfer medium and it is detected on the transfer belt. The feedback control thereafter is the same as that described above.

Also, detecting means 400 (FIG. 1) for detecting the flow speed of the developer, i.e., the transport speed of the developer (i.e., the rotating speed of the screw 4*e*) flowing through the portion opposed to the magnetic sensor can be discretely provided to thereby cope with a case where a drive motor and a gear train for driving the screw 4*e* endure, whereby the rotating speed of the screw 4*e* becomes unstable.

When in such a constructing the rotating speed of the screw 4*e* detected by the detecting means 400 deviates by a predetermined value or greater from a target speed, a patch image is formed as in the above-described example, and the CPU 15 corrects the output v2 of the magnetic sensor or the target value v0 on the basis of the density of the patch image detected by the image density detecting sensor to thereby determine the amount of toner supply and effect the control of the toner supply.

Another embodiment will now be described. In this embodiment, a construction, which will hereinafter be described, can be added to the construction of the above-described embodiment to thereby control the toner supply with high accuracy.

As shown in FIG. 1, a timer 16 as measuring means is provided in the printer, and when it is detected by this internal timer 16 that the printer has been left as it is for a long period before the image forming operation is started, that is, when image formation is started in a state in which the time for leaving the printer as it is (t4-t3 in FIG. 4) has exceeded a predetermined time t0, a patch image is formed during pre-multi-rotation and it is detected by the image density detecting sensor 13, and on the basis of the detected result, the output v3 of the magnetic sensor or the target value v0 is corrected by the CPU to thereby achieve the stabilization of the control of toner supply.

Figure 4:
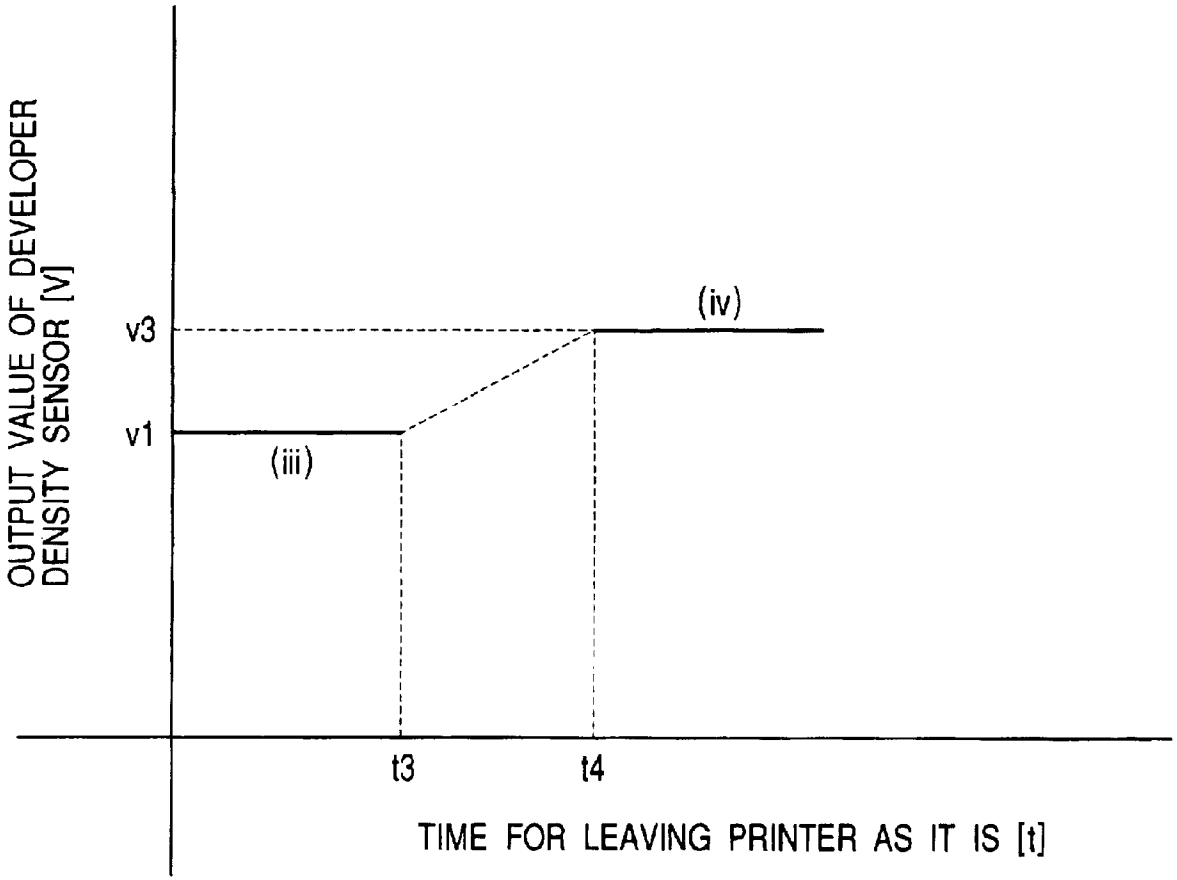
FIG. 4 is a graph showing the relation between the output of the magnetic sensor and the above-mentioned time.

As shown in FIG. 4, the target value of the magnetic sensor is defined v0, and the output of the magnetic sensor obtained at a time t3 which is the time when the last copying (image forming) operation has been completed is defined as v1 ((iii) in FIG. 4). At a time t4 after the printer has been left as it is longer than a predetermined time t0, the output of the magnetic sensor has changed to v3 in spite of toner consumption being not effected ((iv) in FIG. 4). This is attributable to the fact that the bulk density of the developer has changed when the printer is being left as it is.

The time elapsing after the completion of the last copying operation is measured by the timer, and when the time elapsed exceeds the predetermined time t0 and the next image forming operation begins, the above-described pre-multi-rotation process is first operated. During this pre-multi-operation process, the idle rotation of the developing device 4 is effected, and the then output value v3 of the magnetic sensor 14 is read.

Next, a patch image of predetermined density is formed on the photosensitive drum 1 and the density of the patch image is detected by the image density detecting sensor 13, whereafter on the basis of the detected density of the patch image, the correction of the target value v0 with which the output value v3 of the magnetic sensor 14 is to be compared is effected.

This corrected value is defined as v0' and is set as a target value, and the amount of toner supply is calculated by means of this target value v0' and v3 and the toner is supplied, whereby the toner density is controlled to make the density of the image constant.

As described above, the change of the density of the image caused by the change of the output of the magnetic sensor caused by the printer being left as it is can be described, whereby irrespective of the situation in which the printer is left as it is, the density of the toner in the developing device can be maintained proper, and an output image having proper density can be obtained.

Instead of correcting the target value v0 with which the output v3 of the magnetic sensor 14 during toner supply is to be compared on the basis of the result of the detection of the density of the patch image as in the previous embodiment, the output value v3 of the magnetic sensor 14 during toner supply (specifically a coefficient B) may be corrected on the basis of the result of the detection of the density of the patch image.

The output value v3' (=v3+B) of the magnetic sensor 14 during toner supply obtained in this manner is compared with the target value v0, whereby the CPU determines the amount of toner supply.

While the present embodiment has been described with respect to a case where the control of correction is effected immediately before the copying operation after the printer has been left as it is for a predetermined time t0, the control of correction can be effected during standby beyond the predetermined time t0 to obtain a similar effect.

On the other hand, while the description hitherto has been made of a case where it is detected by the timer 16 that the image forming apparatus (printer) has been left as it is for a long period, this is not restrictive, but for example, design may be made such that whether the image forming apparatus has been left as it is for a long period is judged on the basis of any change in the temperature of the fixing device.

Description will now be made of such an example in which whether the image forming apparatus has been left as it is for a long period is judged on the basis of any change in the temperature of the fixing device.

Figure 5:
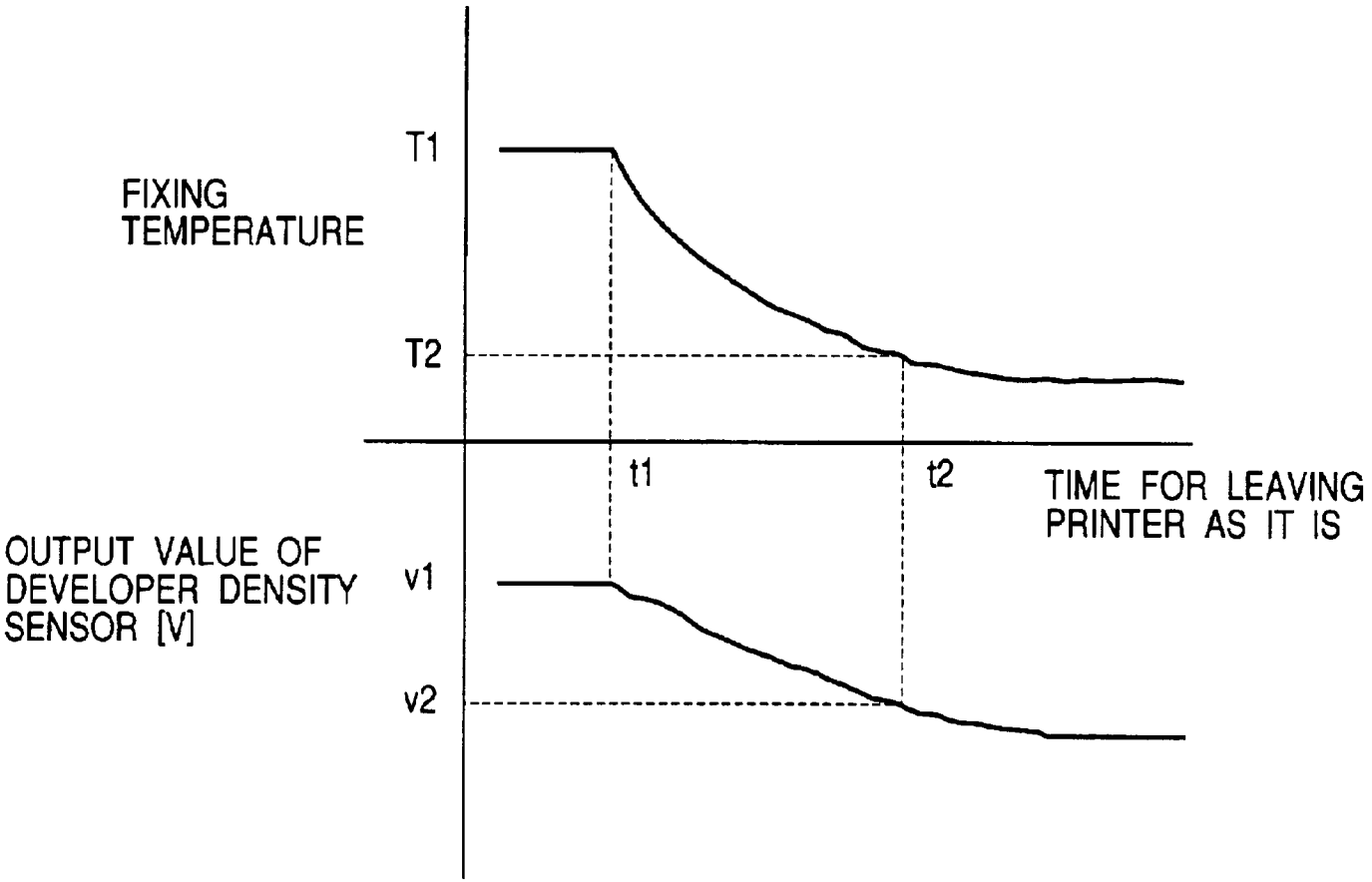
FIG. 5 is a graph showing the relation between a fixing temperature and the above-mentioned time and the relation between the output of the magnetic sensor and the above-mentioned time.
Figure 6:
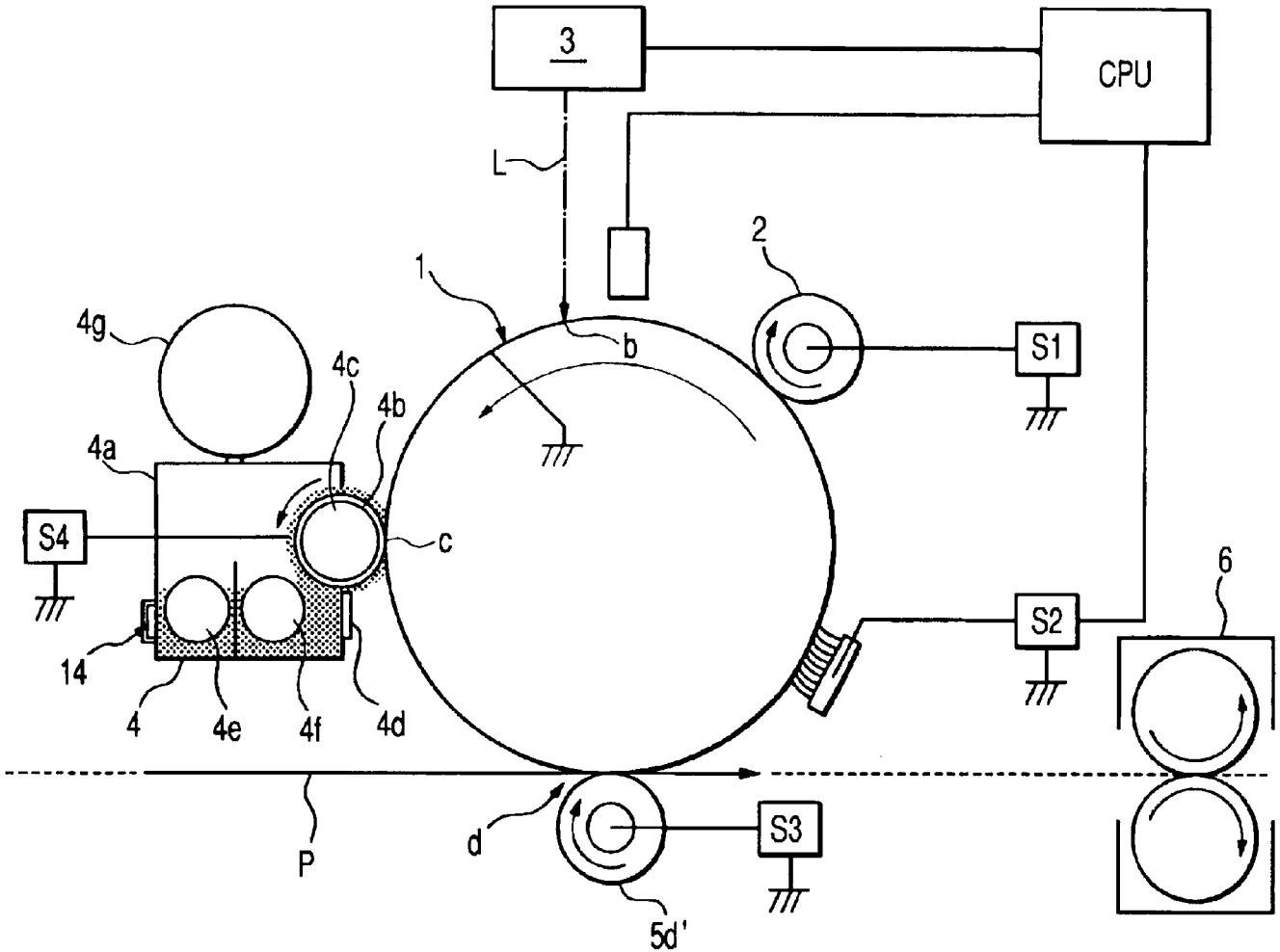
FIG. 6 PRIOR ART
FIG. 6 schematically shows the construction of an image forming apparatus using a conventional electrophotographic process.
Figure 7:
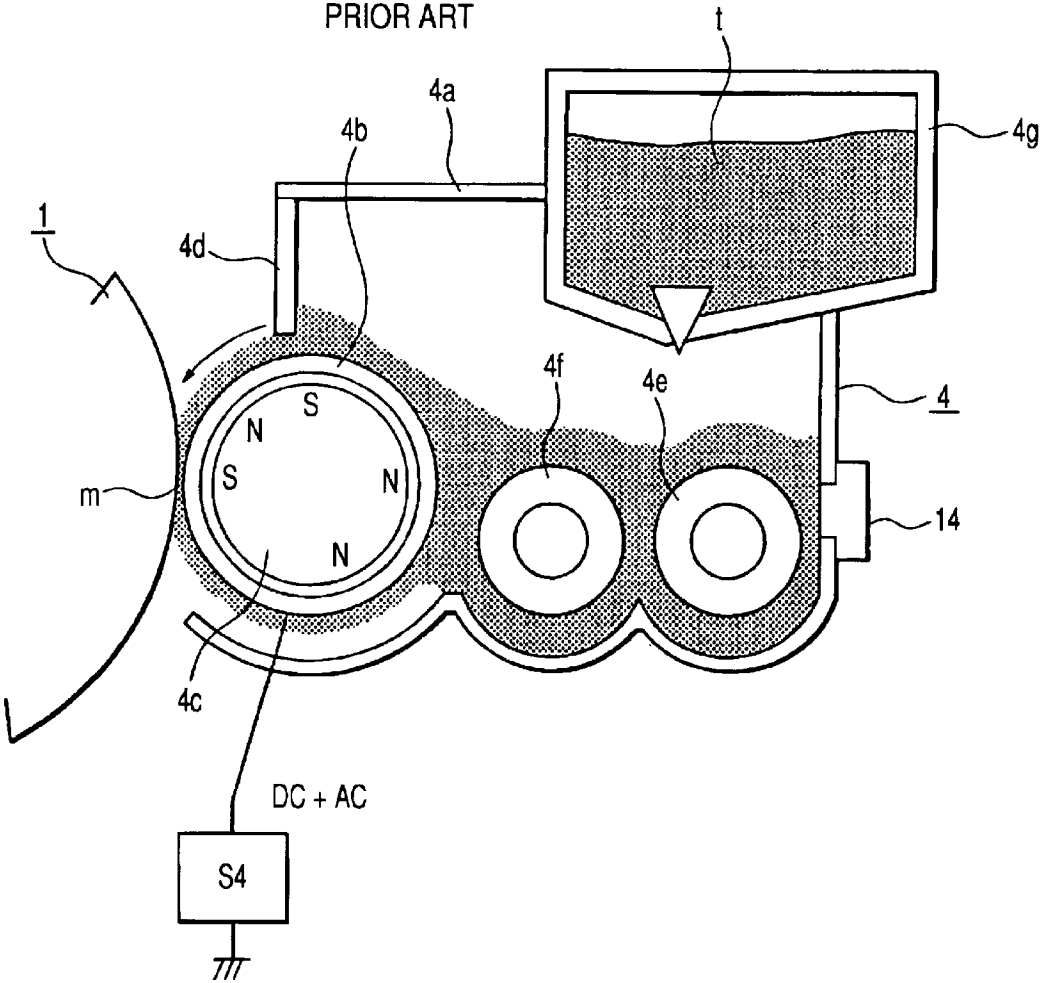
FIG. 7 PRIOR ART
FIG. 7 illustrates a conventional developing device.

FIG. 5 is a graph showing the relation between the fixing temperature of the image forming apparatus according to the present embodiment and the time for leaving the apparatus as it is and between the output of the developer density detecting sensor and the time for leaving the apparatus as it is. In FIG. 5, t1 indicates the time when the image forming operation has been performed lastly, and t2 indicates the time when the fixing temperature decreases to the vicinity of the ordinary temperature.

So, in the present embodiment, the time for leaving the image forming apparatus as it is calculated from the temperature of the fixing device 11 (see FIG. 1), whereby the above described toner supply control is effected.

Specifically, the output value v3 of the magnetic sensor in the developing device is detected during the return time (the pre-multi-rotation process) from the time when the temperature of the fixing device has decreased to a predetermined temperature to the standby which is a state in which copying is possible and also, a patch image of predetermined density is formed on the photosensitive drum 1 and is detected by the image density detecting sensor 13 (see FIG. 1).

The CPU feeds back the result detected by the image density detecting sensor 13 to the already described target value v0 or the output v3 of the magnetic sensor during toner supply to thereby determine the amount of toner supply and execute the control of the toner supply.

Again by adopting a construction in which as described above, the time for leaving the apparatus as it is is obtained on the basis of any change in the temperature of the fixing device, the wrong detection of the output value of the magnetic sensor can be eliminated. Thereby, the oversupply of the toner can be decreased and the stabilization of the density of an output image can be achieved.

What is claimed is:

1. An image forming apparatus comprising:

a developing device for developing an electrostatic image formed on an image bearing member with a developer containing nonmagnetic toner and magnetic carrier;

toner density detecting means for magnetically detecting a density of the toner in the developing device;

control means for controlling an amount of toner to be supplied to the developing device on the basis of an output detected by the toner density detecting means and a target value; and image density detecting means for detecting a density of a predetermined toner image formed by the developing device, wherein the developing device can execute a developing operation at a first speed and a second speed differing from the first speed, and wherein in a case where a last developing operation is executed at the first speed, whereafter a next developing operation is executed at the second speed, the control means determines the amount of toner supply by use of the target value corrected on the basis of the output of the image density detecting means.

2. An image forming apparatus according to claim 1, wherein in a case where the last developing operation is executed at the first speed, whereafter the next developing operation is executed at the second speed, the predetermined toner image is formed and the density of the predetermined toner image is detected by the image density detecting means.

3. An image forming apparatus according to claim 2, further comprising a screw member for transporting the developer in the developing device, the screw member being rotatable at the first speed and the second speed.

4. An image forming apparatus according to claim 3, wherein the toner density detecting means is provided in an area opposed to the screw member.

5. An image forming apparatus according to claim 1, wherein in a case where toner supply is effected in a state in which a predetermined time or longer has elapsed after the last developing operation has been completed, the control means determines an amount of toner supply by the use of the target value corrected on the basis of the output of the image density detecting means.

6. An image forming apparatus comprising:

a developing device for developing an electrostatic image formed on an image bearing member with a developer containing nonmagnetic toner and a magnetic carrier;

toner density detecting means for magnetically detecting a density of the toner in the developing device;

control means for controlling an amount of toner to be supplied to the developing device on the basis of an output detected by the toner density detecting means and a target value; and image density detecting means for detecting a density of a predetermined toner image formed by the developing device, wherein the developing device can execute a developing operation at a first speed and a second speed differing from the first speed, and wherein in a case where the last developing operation is executed at the first speed, whereafter the next developing operation is executed at the second speed, the control means determines an amount of toner supply by use of the output of the toner density detecting means corrected on the basis of an output of the image density detecting means.

7. An image forming apparatus according to claim 6, wherein in a case where the last developing operation is executed at the first speed, whereafter the next developing operation is executed at the second speed, the predetermined toner image is formed and the density of the predetermined toner image is detected by the image density detecting means.

8. An image forming apparatus according to claim 7, further comprising a screw member for transporting the developer in the developing device, the screw member being rotatable at the first speed and the second speed.

9. An image forming apparatus according to claim 8, wherein the toner density detecting means is provided in an area opposed to the screw member.

10. An image forming apparatus according to claim 6, wherein in a case where toner supply is effected in a state in which a predetermined time or longer has elapsed after the last developing operation has been completed, the control means determines an amount of toner supply by use of the output of the toner density detecting means corrected on the basis of the output of the image density detecting means.

11. An image forming apparatus comprising:

a developing device for developing an electrostatic image formed on an image bearing member with a developer containing a nonmagnetic toner and a magnetic carrier;

toner density detecting means for magnetically detecting a density of the toner in the developing device;

control means for controlling an amount of toner to be supplied to the developing device on the basis of an output detected by the toner density detecting means and a target value;

switching means for switching between developing speeds of said developing device, wherein said developing device can develop the electrostatic image at any of the developing speeds; and correcting means for correcting the output in accordance with a switching between the developing speeds.

12. An image forming apparatus according to claim 11, further comprising image density detecting means for detecting a density of a predetermined toner image formed by the developing device, wherein said correcting means corrects the output using a detection result from said image density detecting means.

* * * * *

UNITED STATES PATENT AND TRADEMARK OFFICE

CERTIFICATE OF CORRECTION

PATENT NO. : 6,947,681 B2
APPLICATION NO. : 10/354027
DATED : September 20, 2005
INVENTOR(S) : Takao Ogata It is certified that error appears in the above-identified patent and that said Letters Patent is hereby corrected as shown below:

On Title Page Col. 1

UNDER ASSIGNEE, ITEM (73):

"Canon Kabushik Kaisha" should read --Canon Kabushiki Kaisha--.

Signed and Sealed this

Twenty-fifth Day of July, 2006

JON W. DUDAS
*Director of the United States Patent and Trademark Office*